US006116502A

United States Patent [19]

Noseworthy et al.

[11] Patent Number: 6,116,502

[45] Date of Patent: Sep. 12, 2000

[54] RECLOSEABLE CONTAINER WITH POURING SPOUT

[75] Inventors: Gary Richard Noseworthy, Burlington; Gregory William Shelton, Goderich; Richard Marshall, Hamilton; Gregory Kimmett, Brampton; Ronald Arthur Millichamp, Oakville; Wayne Petrie, London; Patrick Bruce, Toronto, all of Canada

[73] Assignee: Sifto Canada Inc., Ontario, Canada

[21] Appl. No.: 09/137,796

[22] Filed: Aug. 21, 1998

[51] Int. Cl.[7] ..... B65D 5/70

[52] U.S. Cl. ..... 229/215; 229/221

[58] Field of Search ..... 229/122, 125.42, 229/215, 221

[56] References Cited

U.S. PATENT DOCUMENTS

| | | | |
|---|---|---|---|
| 1,585,494 | 5/1926 | Harvey | 229/221 |
| 2,228,181 | 1/1941 | Perryman | 229/221 |
| 2,338,260 | 1/1944 | Ringler | 229/215 |
| 2,842,302 | 7/1958 | Ryder | 229/215 |
| 3,131,847 | 5/1964 | Desmond | 229/215 |
| 3,335,933 | 8/1967 | Woodling | 229/221 |
| 3,397,833 | 8/1968 | Champlin | 229/221 |
| 3,542,259 | 11/1970 | Marchesani | 229/122 |
| 3,692,227 | 9/1972 | Hennessey et al. | 229/215 |
| 4,168,003 | 9/1979 | Wysocki . | |
| 4,194,677 | 3/1980 | Wysocki . | |
| 4,356,951 | 11/1982 | Sharp | 229/125.42 |
| 4,684,058 | 8/1987 | Weber . | |
| 4,732,275 | 3/1988 | Hambleton et al. . | |
| 4,921,104 | 5/1990 | Holmes . | |
| 4,967,910 | 11/1990 | Schuster . | |
| 5,215,250 | 6/1993 | Roccaforte | 229/215 |
| 5,238,181 | 8/1993 | Mahler | 229/215 |
| 5,377,876 | 1/1995 | Smernoff | 222/105 |
| 5,429,297 | 7/1995 | Walsh | 229/215 |
| 5,494,216 | 2/1996 | Van Suntenmaartensdijk | 229/215 |
| 5,660,324 | 8/1997 | Rowland | 229/215 |

FOREIGN PATENT DOCUMENTS

| | | | |
|---|---|---|---|
| 678370 | 1/1964 | Canada | 229/221 |
| 1037954 | 8/1958 | Germany | 229/215 |

*Primary Examiner*—Gary E. Elkins
*Attorney, Agent, or Firm*—Ladas & Parry

[57] ABSTRACT

The present invention provides a container having a pair of walls intersecting along a common edge to form a comer, an opening formed in each of the walls and extending across the common edge, whereby a spout is formed by edges of the walls which define the opening. Preferably the container further comprises a selectively removable flap for overlaying the opening, the flap in hinged attachment with one of the pair of walls of the container, proximal the opening, the flap moveable away from the opening to permit access thereto. A blank for forming the container is also provided.

10 Claims, 5 Drawing Sheets

RECLOSEABLE CONTAINER WITH POURING SPOUT

The present application relates to the field of containers. More specifically the present invention relates to a recloseable container with a pouring spout suitable for dispensing powder and granular products.

BACKGROUND OF THE INVENTION

Numerous containers with recloseable pour spouts are known in the art. For example, U.S. Pat. No. 4,799,594 to Blackman, issued Jan. 24, 1989, discloses a container formed of two panels disposed in overlaying relation to each other with an inner one of the two panels having dispensing openings there through and the outer one of the panels having formed therein a closure flap. The flap is formed as an integral part of one end of the container and is connected thereto by means of a hinge and perforated lines on two opposing sides. In order the open the container, the flap is lifted away from the container wall by breaking the perforations. In order to close the container, the flap must be depressed so that projections on the sides thereof are locked by friction within the end wall of the container. The inner panel has a plurality of dispensing openings positioned in the top of the container to allow the contents of the container to be spread effectively when the container is used as a shaker. One disadvantage of Blackman's container is that the plurality of openings in the top of the container does not allow for the contents to be dispensed in a single continuous controllable stream. Also the blank has to be punched to form the opening, thus requiring an extra step in the manufacturing process.

U.S. Pat. No. 4,967,910 to Schuster, issued Nov. 6, 1990, discloses a recloseable side-opening box. The box is provided with a shield shaped aperture with a saw-toothed edge on one side thereof. A hinged flap is provided which acts as a spreader. The spreader is disposed horizontally below the pour spout and serves to evenly distribute the contents of the container. When the container is not in use the spreader is pushed back such that it covers the aperture. One disadvantage of Schuster is that the container is designed solely for spreading the dispensed contents over a wide area.

U.S. Pat. No. 5,333,781 to Roccaforte, issued Aug. 2, 1994, discloses a product dispensing carton having a recloseable pouring spout in the top wall thereof. Similar to Blackman discussed above, Roccaforte teaches that the carton should be provided with a plurality of apertures which facilitates dispensement of the contents when the container is used as a shaker. Roccaforte suffers from the same disadvantages as the other prior art containers.

SUMMARY OF THE INVENTION

It is an object of the present invention to obviate or mitigate at least one of the disadvantages of the prior art. Accordingly, in a first aspect, the present invention provides a container having a pair of walls intersecting along a common edge to form a comer, an opening formed in each of the walls and extending across the common edge, whereby a spout is formed by edges of the walls which define the opening.

In another aspect, the present invention provides a container having a pair of walls joined along a common edge to form a comer, the container comprising inner and outer panels disposed in overlapping relation, the inner panel having a dispensing opening therein, a portion of the dispensing opening extending across the common edge, the inner panel also having a slot therethrough spaced from the dispensing opening, the outer panel having a flap for overlaying the dispensing opening, the flap hinged at one end thereof to permit movement of the flap away from the dispensing opening and having a tab portion at an opposed end thereof from removable insertion in the slot in the inner panel for maintaining the flap in overlaying relationship with the dispensing opening.

In yet another aspect the present invention provides a container blank comprising a plurality of panels connected in seriatim, the plurality of panels delimited by fold lines to define common edges between adjacent panels, a pair of adjacent panels having an opening extending across a fold line to define a discharge opening.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENT

Figure 1:
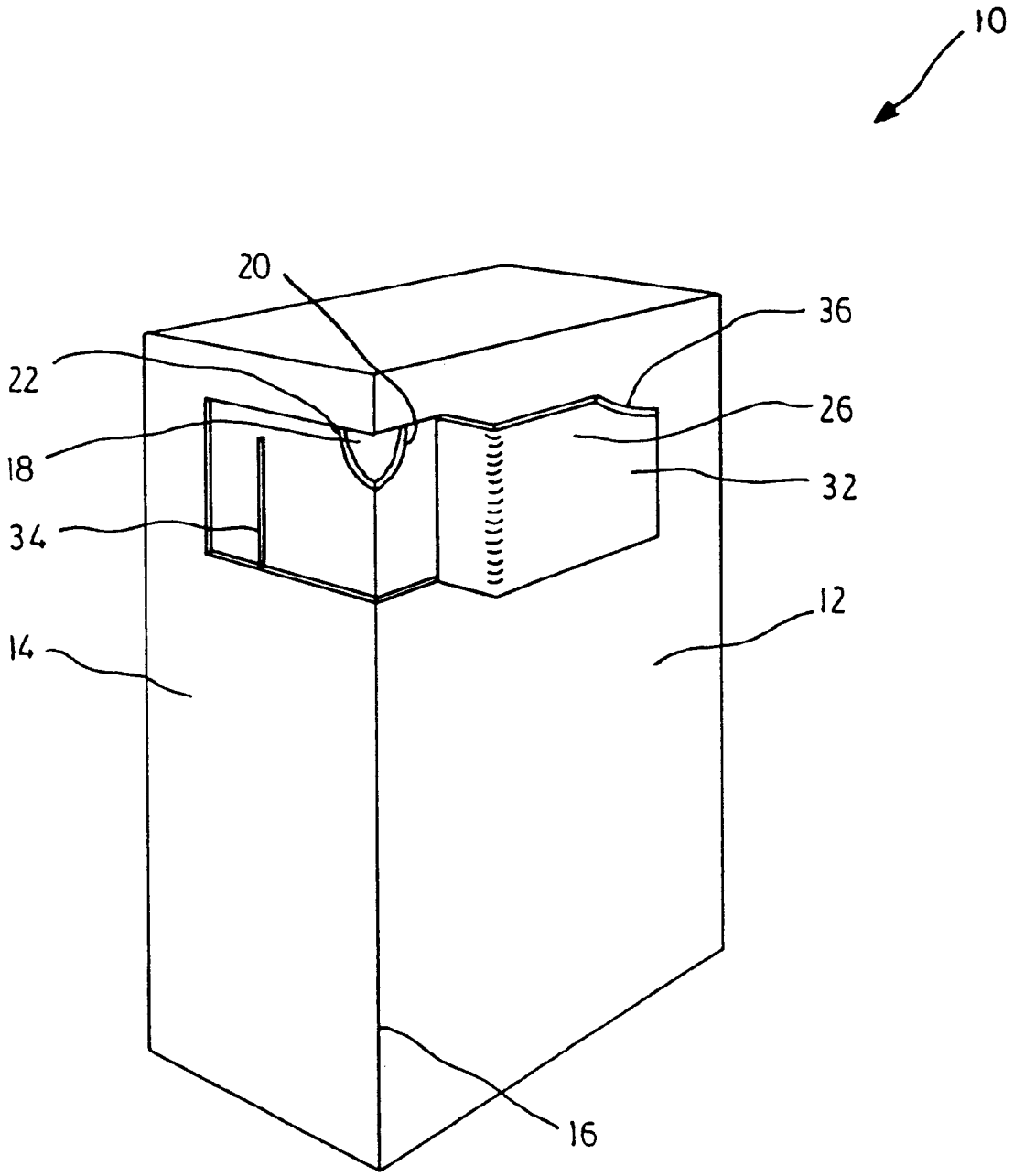
FIG. 1 is a respective view of a container in accordance with one embodiment of the present invention in its open position.
Figure 2:
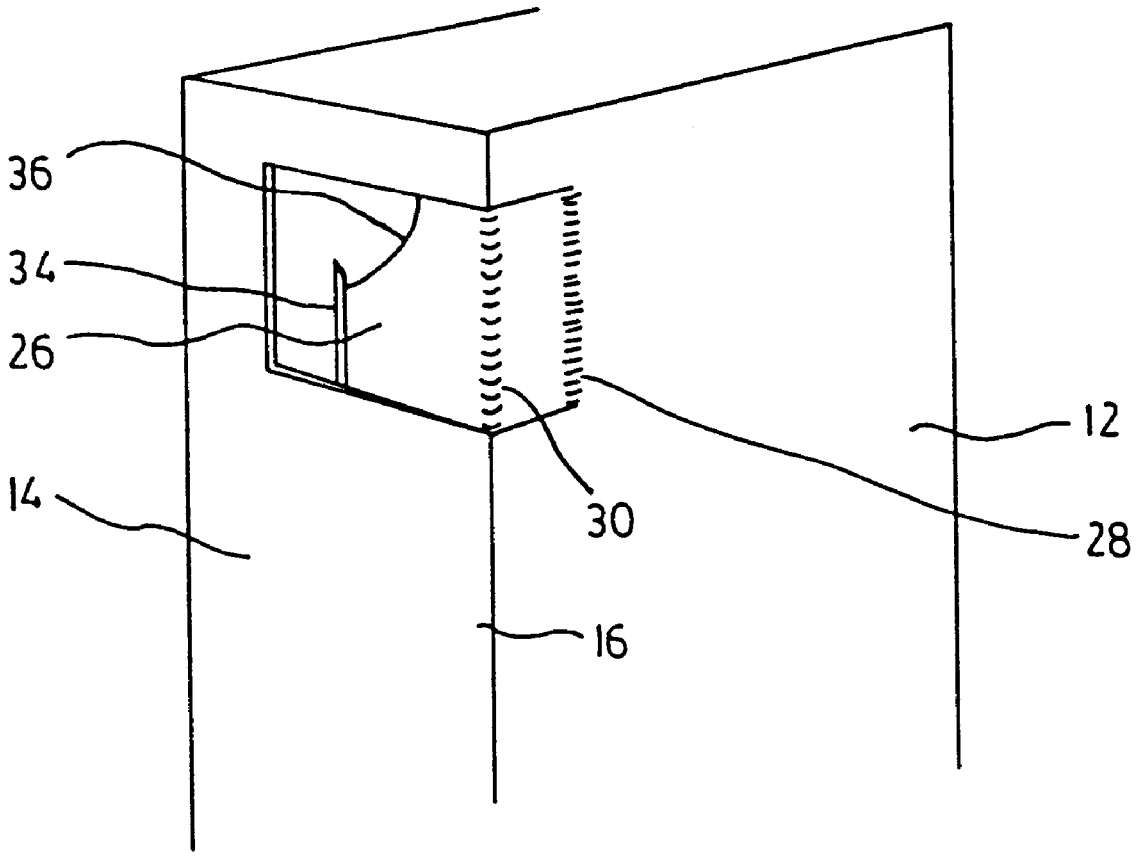
FIG. 2 is a partial exploded view of the pour spout and reclosure flap of the container of FIG. 1 in the closed position.

A container in accordance with a first embodiment of the present invention is shown generally at 10 in FIGS. 1 and 2. The container comprises a pair of walls 12 and 14 which join along a common edge 16 to form a comer. An opening 18 is formed in each of walls 12 and 14 which extends across the common edge 16. The edges 20 and 22 of walls 12 and 14, respectively, around the opening 18 define a dispensing spout.

Container 10 is also provided with a flap 26 which selectively removeably overlays opening 18. The flap is shown in an open position in FIG. 1 and a closed, i.e., overlaid, position in FIG. 2. Flap 26 is attached to wall 12 by a hinge 28, preferably formed by a fold in the material of wall 12. Flap 26 is itself hinged (30) such that the portion of the flap distal hinge 28 can lie flush one wall 14.

Flap 26 is preferably provided with a tab 32 which may be inserted into a slot 34 formed through wall 14 so as to maintain the flap in its overlaid position, thereby sealing opening 18.

Figure 4A:
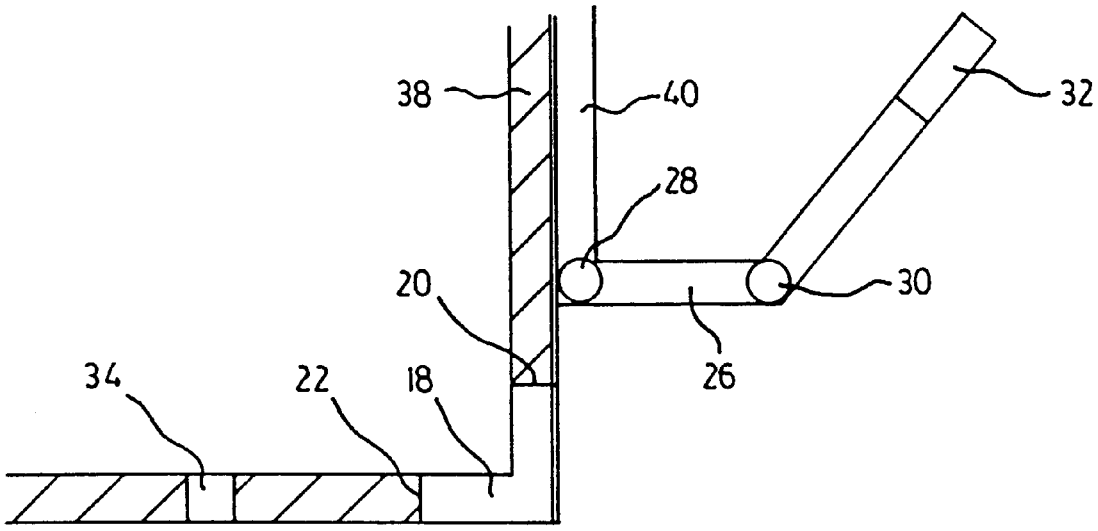
FIGS. 4A and 4B are partial cross-sectional views of the containers of FIGS. 1 and 2, respectively.
Figure 4B:
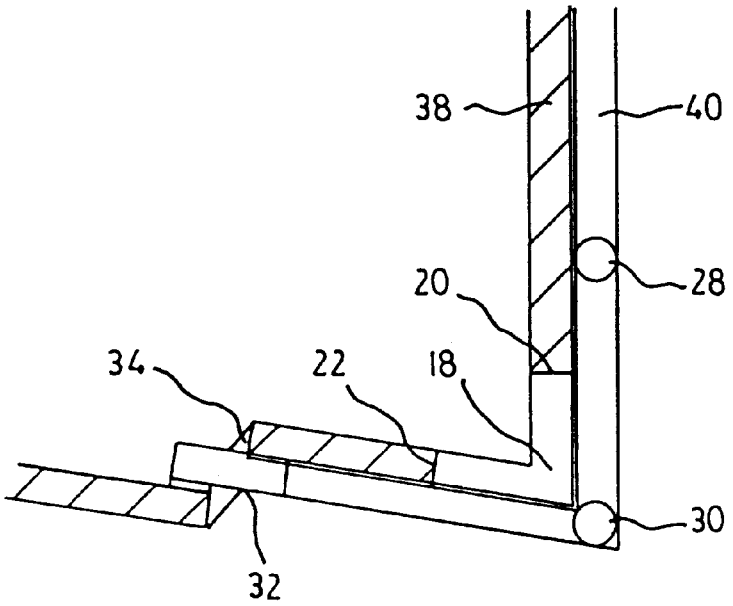

In the embodiment shown in FIGS. 1 and 2, flap 26 has a curved edge 36 proximal tab 32 which acts as a finger grip to facilitate opening of the flap In the embodiments shown, the portions of walls 12 and 14 proximal opening 18 are formed from an inner panel 38 and an outer panel 40, as shown in FIGS. 4A and 4B. The inner and outer panels are disposed in overlapping relation. Opening 18 and slot 34 are formed in the inner panel and flap 26 is formed in the outer panel. FIG. 4A shows the container in its open position with flap 26 disposed away from opening 18 and FIG. 4B shows the container in its closed position with flap 26 overlaying opening 18 and tab 32 inserted and retained within slot 34.

Figure 3:
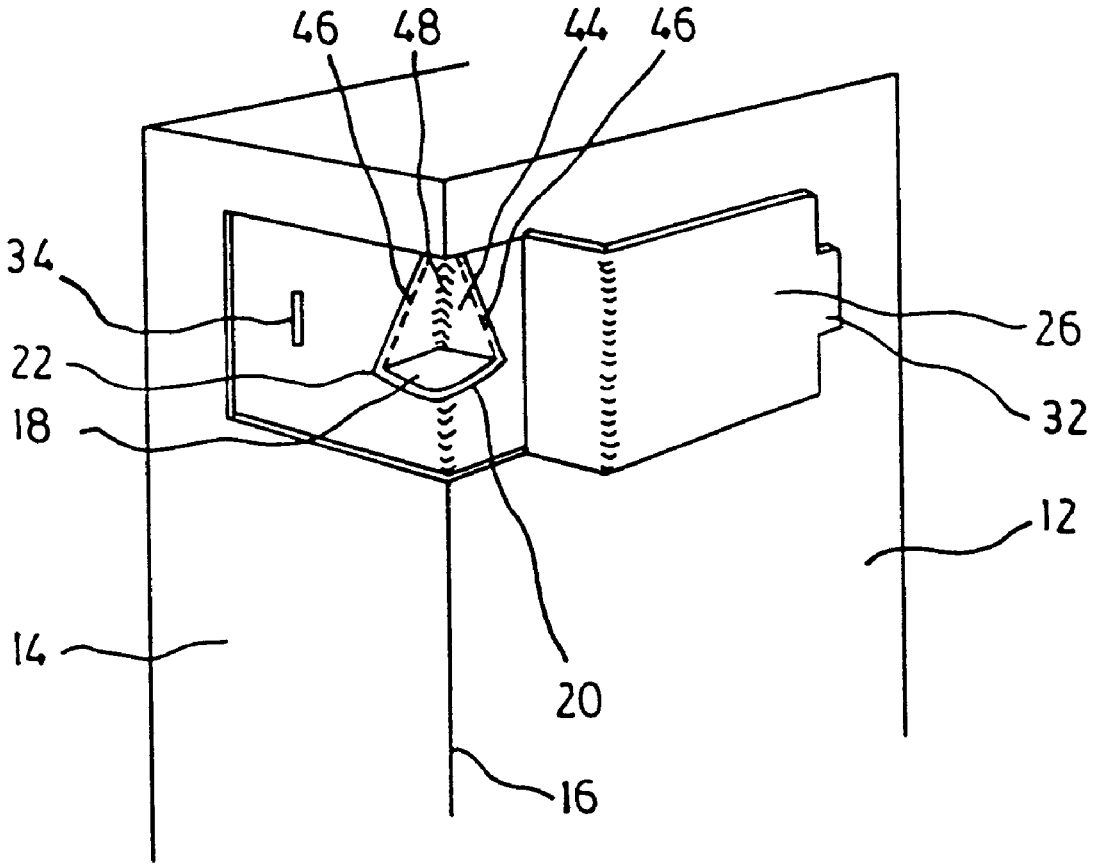
FIG. 3 is a partial exploded view of a pouring spout and closure flap in accordance with a second embodiment of the present invention in the open position.

In the embodiment shown in FIG. 3, opening 18 is formed by a user by depressing a flexible web 44 into the container. Web 44 is attached to inner panel 38 by perforations 46 which provide a flexible link between web 44 and inner panel 38. Web 44 is provided with a fold 48 which shapes the web so that it acts as an internal channel within the container to direct the contents of the container through opening 18.

Figure 5:
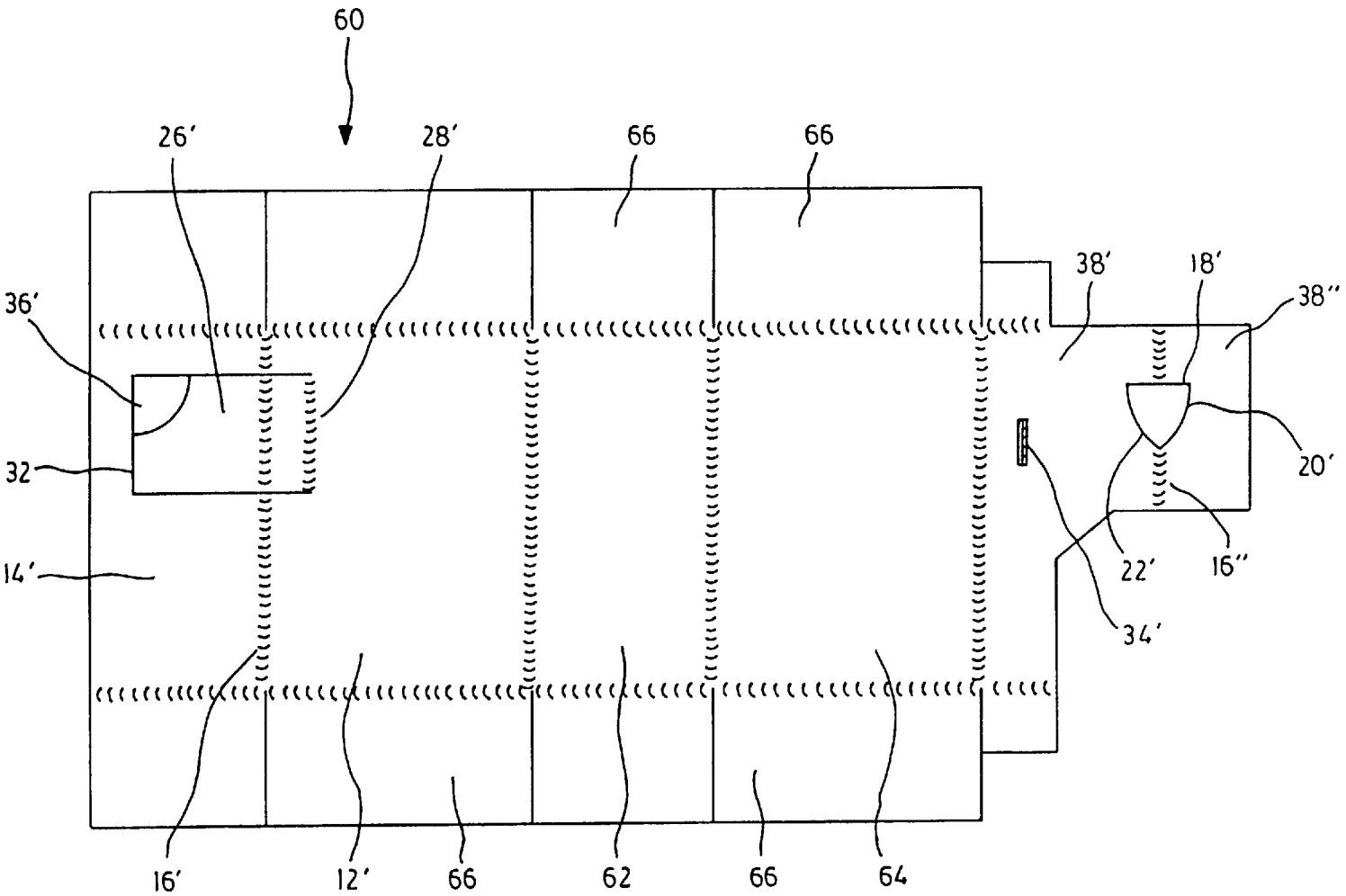
FIG. 5 is a plan view of a blank for forming the container of FIG. 1.

FIG. 5 illustrates a blank for forming a container in accordance with the present embodiment, the blank being generally indicated at 60. In FIG. 5, like parts are identified by the same reference numerals as used in the previous figures, with a prime (') added for clarity.

Blank 60 comprises a plurality of panels connected in seriatim, including panels 12' and 14' which form side walls 12 and 14, respectively. The plurality of panels are delimited by fold lines such as 16' to define common edges between adjacent panels. A pair of adjacent panels 38' and 38" (which form part of the inner panel 38 when the container is constructed) have an opening 18' which extends across a fold line 16" between the panels. Edges 20' and 22' around the opening 18' define a dispensing spout.

Panel 12' and 14', which are spaced from panels 38' and 38", are provided with a flap 26'. The flap is hinged to panel 12' (which forms part of the inner panel 38 when the container is constructed) by a fold 28'. The panel is provided with a tab 32' and has a curved edge 36' which acts as a finger grip.

Blank 60 is preferably formed from paperboard. Each of the primary panels of the blank, i.e., 12' , 14' 62 and 64, which form the sides of the container when constructed, are provided with end flaps 66 which in use are overlapped with one another in a conventional manner to for a sealed top and bottom for the container.

While the invention has been described in connection with specific embodiments thereof and in a specific use, various modifications thereof will occur to those skilled in the art without departing from the spirit of the invention as set forth in the appended claims.

The terms and expressions which have been employed in the specification are used as terms of description and not of limitations, there is no intention in the use of such terms and expressions to exclude any equivalents of the features shown and described or portions thereof, but it is recognized that various modifications are possible within the scope of the claims to the invention.

We claim:

1. A container having a pair of walls joined along a common edge to form a corner, the container comprising inner and outer panels disposed in overlapping relation, the inner panel having a dispensing opening therein, a portion of the dispensing opening extending across the common edge, the inner panel also having a slot therethrough spaced from the dispensing opening, the outer panel having a flap for overlaying the dispensing opening, the flap hinged at one end thereof to permit movement of the flap away from the dispensing opening and having a tab portion at an opposed end thereof from removable insertion in the slot in the inner panel for maintaining the flap in overlaying relationship with the dispensing opening.

2. The container of claim 1 wherein said container is formed from a unitary foldable structure.

3. The container of claim 2 wherein said foldable structure comprises a cardboard blank.

4. A blank for the container of claim 1, said blank being formed of a foldable material and comprising a plurality of panels delimited by fold lines, said plurality of panels including a pair of adjacent panels, and an opening extending across a portion of said pair of adjacent panels and the fold line therebetween.

5. The blank of claim 4 wherein said blank is formed of cardboard.

6. A container having a pair of walls joined along a common edge to form a corner, said pair of walls including overlapping portions thereby defining an inner panel and an outer panel at said comer, the inner panel having a dispensing opening therein, a portion of the dispensing opening extending across the common edge, the inner panel also having a slot therethrough spaced from the dispensing opening, the outer panel having a flap for overlaying the dispensing opening, the flap hinged at one end thereof to permit movement of the flap away from the dispensing opening and having a tab portion at an opposed end thereof from removable insertion in the slot in the inner panel for maintaining the flap in overlaying relationship with the dispensing opening.

7. The container of claim 6 wherein said container is formed from a unitary foldable structure.

8. The container of claim 7 wherein said foldable structure comprises a cardboard blank.

9. A blank for the container of claim 6, said blank being formed of a foldable material and comprising a plurality of panels delimited by fold lines, said plurality of panels including a pair of adjacent panels, and an opening extending across a portion of said pair of adjacent panels and the fold line therebetween.

10. The blank of claim 9 wherein said blank is formed of cardboard.

* * * * *